US006050441A

United States Patent [19]

Kuo

[11] Patent Number: 6,050,441

[45] Date of Patent: Apr. 18, 2000

[54] SEALING CONTAINER

[76] Inventor: Wen-Hsien Kuo, 54, Kaian 3rd Street, Tainan City, Taiwan

[21] Appl. No.: 09/379,301

[22] Filed: Aug. 23, 1999

[51] Int. Cl.[7] ..... B65D 45/16

[52] U.S. Cl. ..... 220/324; 220/840; 220/849; 215/327

[58] Field of Search ..... 220/833, 840, 220/842, 849, 324, 326; 215/235, 237, 245

[56] References Cited

U.S. PATENT DOCUMENTS 5,147,054 9/1992 Pehr ..... 215/237 X
5,385,257 1/1995 Hung ..... 220/324
5,582,314 12/1996 Quinn et al. ..... 220/326
5,738,238 4/1998 Yang ..... 220/324

*Primary Examiner*—Stephen K. Cronln
*Attorney, Agent, or Firm*—Pro-Techtor International Services

[57] ABSTRACT

A sealing container, which includes a container body, an internally ribbed split locating ring mounted around the container body, a clamp fastened to flanged ends of the split locating ring to fix the split locating ring to the container body, a cover pivoted to the flanged ends of the split locating ring, a rubber seal ring fastened to the cover at a bottom side for sealing the container body, a lever pivoted to the a fixed block at the split locating ring, and a locking plate pivoted to the lever and controlled by the lever to lock the cover after closing of the cover on the container body.

1 Claim, 6 Drawing Sheets

SEALING CONTAINER

BACKGROUND OF THE INVENTION

The present invention relates to a sealing container, and more particularly to such a sealing container, which is convenient in use.

A variety of sealing containers have been disclosed, and have appeared on the market. FIGS. 1 and 2 show a sealing container according to the prior art. This structure of sealing container comprises a container body 500 having a fixed block 100 raised from the periphery and defining a pivot hole 101, a link 300 having two parallel lug 301 bilaterally disposed at one end and pivotably coupled to the pivot hole 101 at the fixed block 100 by a pivot 302 and a pivot hole 303 transversely disposed at an opposite end, cover 600 pivoted to the container body 500 by a pivot 501, the cover 600 having a downward flange 601 raised from the bottom side thereof around the periphery and a peripheral hook 200, an annular rubber sealing member 700 mounted around the downward flange 601 at the bottom side of the cover 600, and a locking plate 400 coupled to the link 300 for locking the cover 600. The locking plate 400 comprises a body 401, a pair of lugs 402 raised from the bottom side wall of the body 401, the lugs 402 each defining a pivot hole 4021 respectively pivotably coupled to the pivot hole 303 at the link 300 by a pivot 403, and a hook 404 raised from the bottom side wall of the body 401 for hooking on the peripheral hook 200 at the cover 600. This structure of sealing container has drawbacks. One drawback of this structure of sealing container is its complicated structure. Another drawback of this structure of sealing container is that the cover 600 can not be easily disconnected from the container body 500 for cleaning. Further, because the annular sealing member 700 is mounted around the downward flange 601 at the bottom side of the cover 600, it may fall from the downward flange 601 of the cover 600 when the cover 600 is turned relative to the container body 500 between the locking position and the unlocking position.

SUMMARY OF THE INVENTION

The present invention has been accomplished to provide a sealing container, which eliminates the aforesaid drawbacks. According to one aspect of the present invention, the sealing container comprises a container body, an internally ribbed split locating ring mounted around the container body, a clamp fastened to flanged ends of the split locating ring to fix the split locating ring to the container body, a cover pivoted to the flanged ends of the split locating ring, a rubber seal ring fastened to the cover at a bottom side for sealing the container body, a lever pivoted to the a fixed block at the split locating ring, and a locking plate pivoted to the lever and controlled by the lever to lock the cover after closing of the cover on the container body. According to another aspect of the present invention, the clamp has two hooked ends releasably hooked in a respective hook hole at each flanged end of the split locating ring. By disengaging the hooked ends of the clamp from the respective hook holes at the split locating ring, the cover and the split locating ring can easily be disconnected from the container body for washing. Because the rubber sealing ring is fastened to the locating groove at the bottom side of the cover, it is well protected, and will not fall from the cover easily.

DETAILED DESCRIPTION OF THE PREFERRED EMBODIMENT

Figure 1:
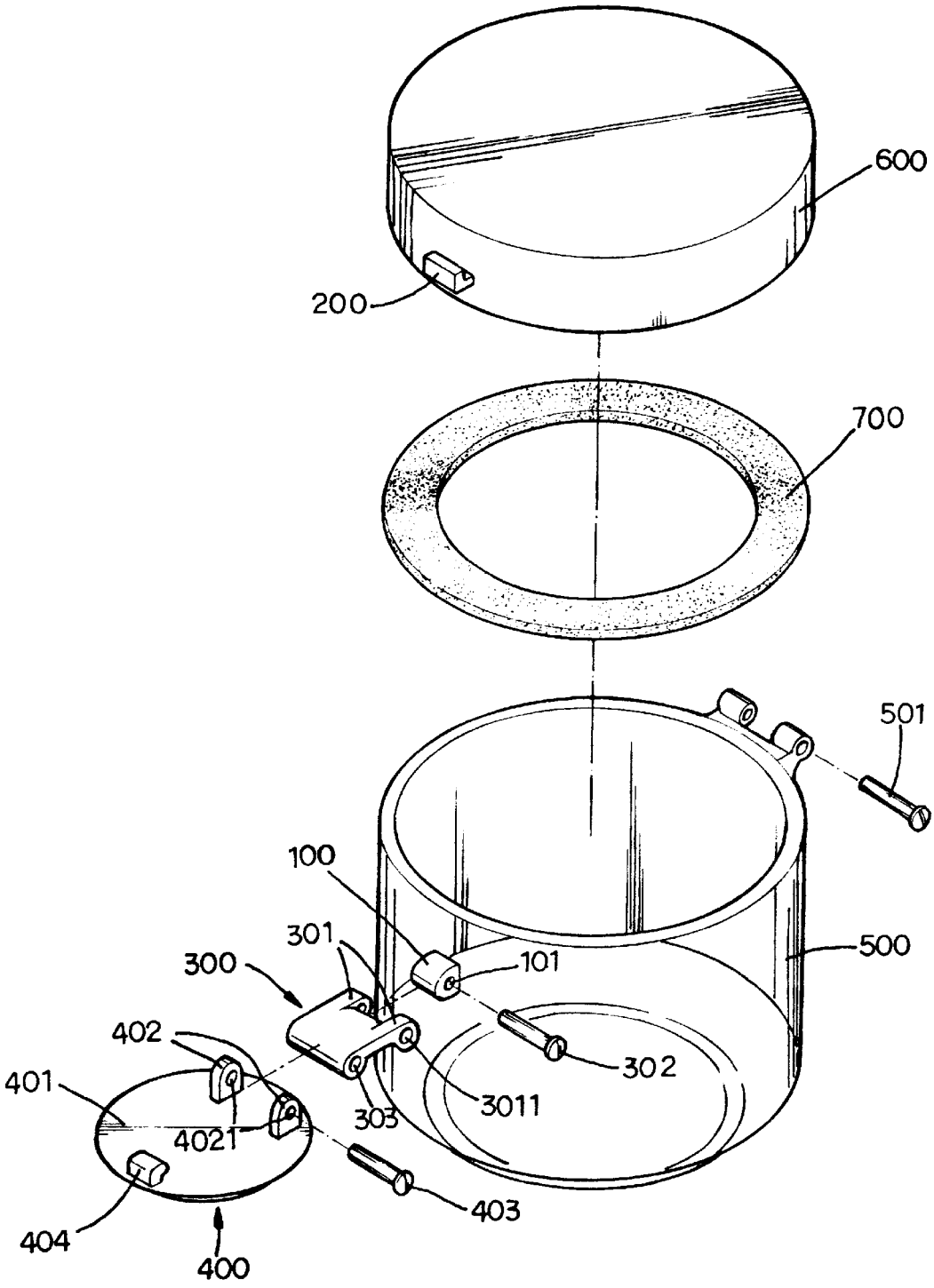
Fig.1 (Prior Art)
FIG. 1 is an exploded view of a sealing container according to the prior art.
Figure 2:
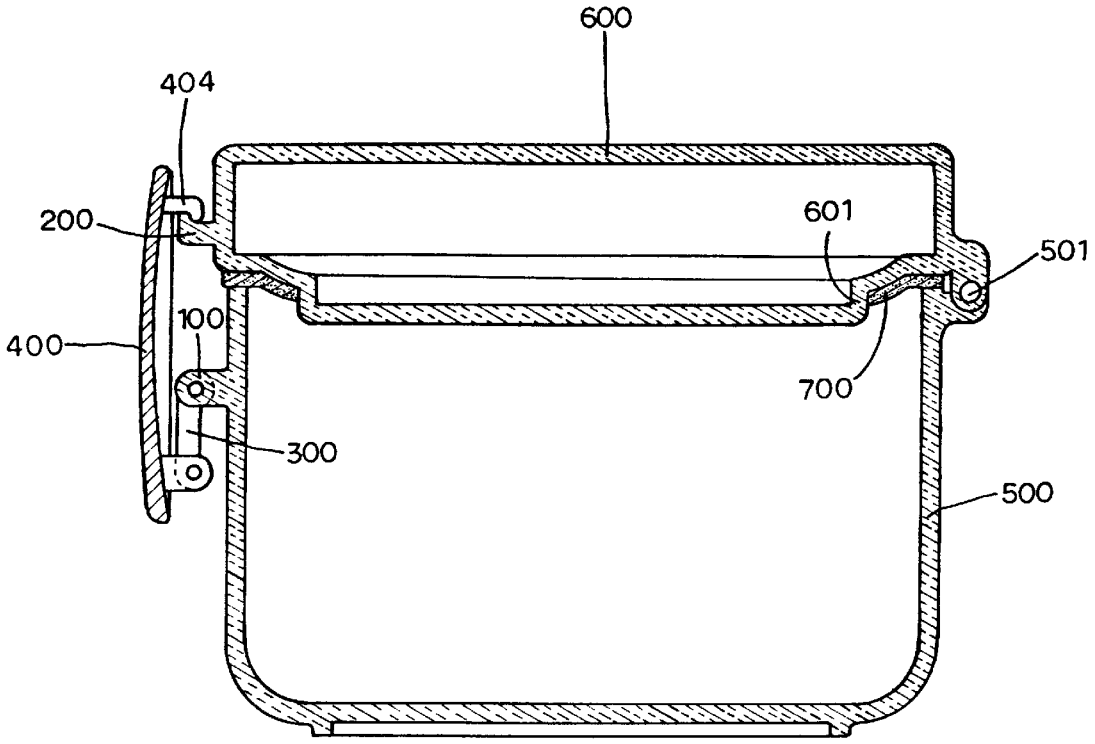
Fig.2(Prior Art)
FIG. 2 is a sectional assembly view of the sealing container according to the prior art.
Figure 3:
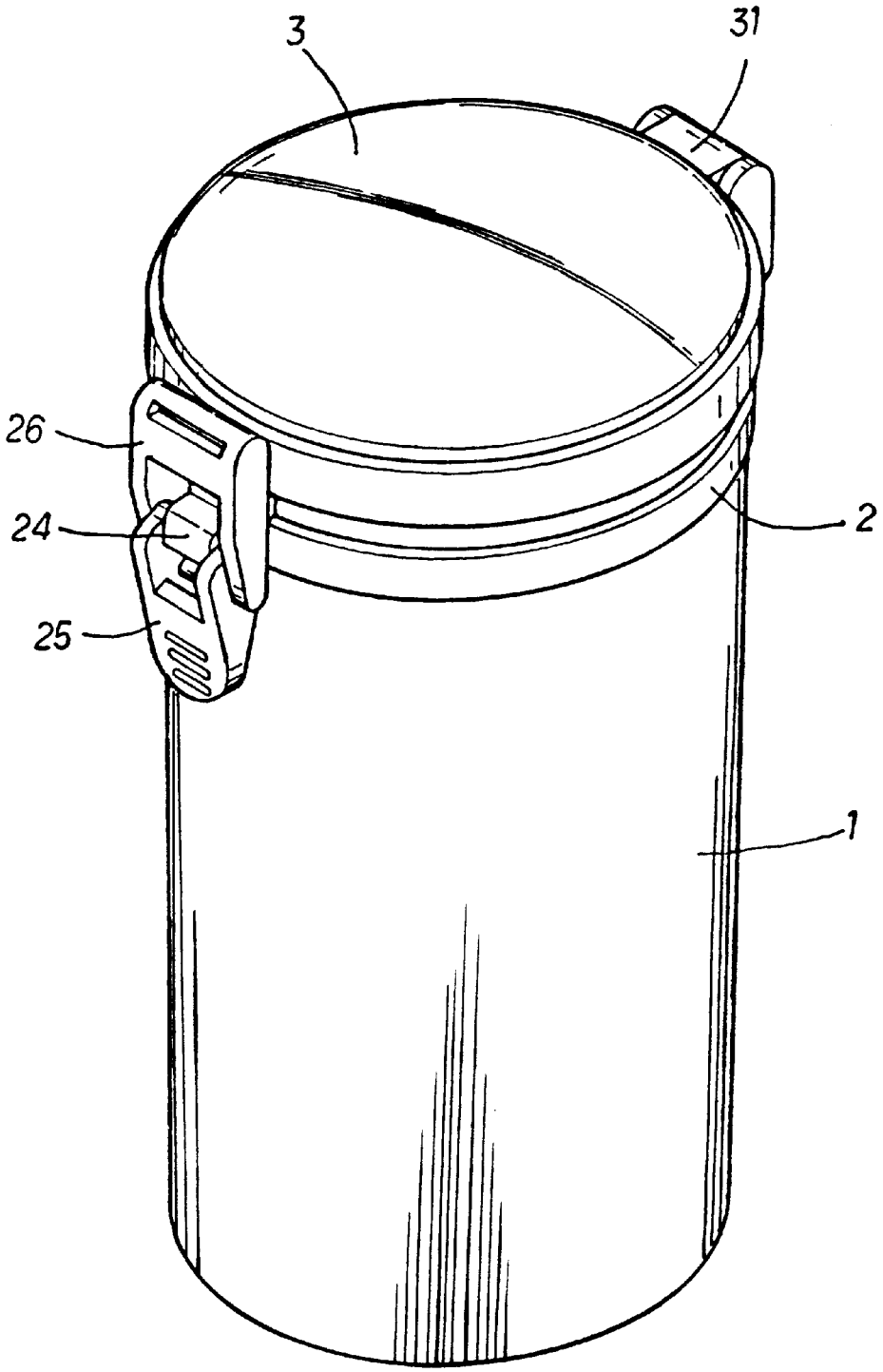
FIG. 3 is an elevational view of a sealing container according to the present invention.
Figure 4:
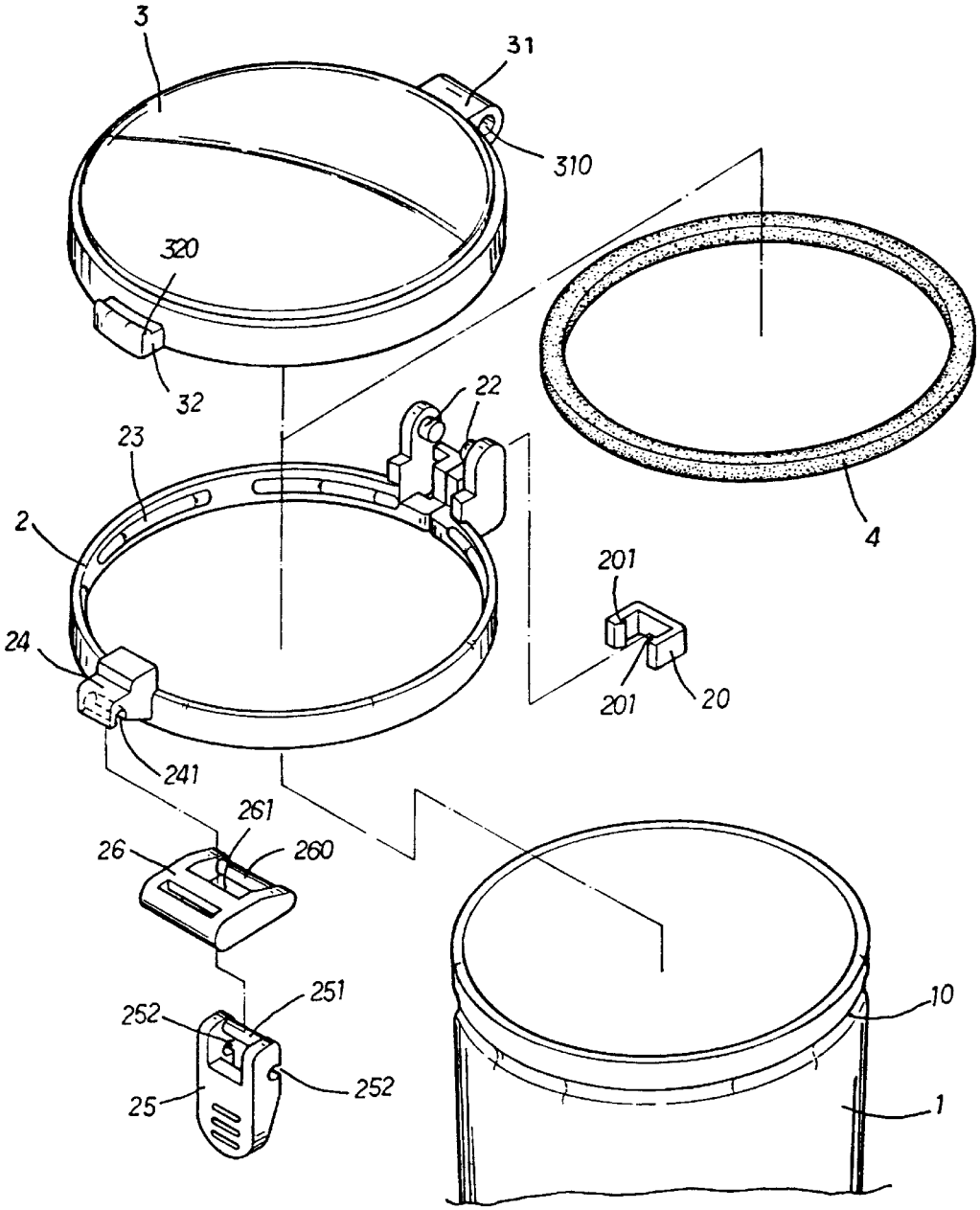
FIG. 4 is an exploded view of the sealing container of the present invention.
Figure 5:
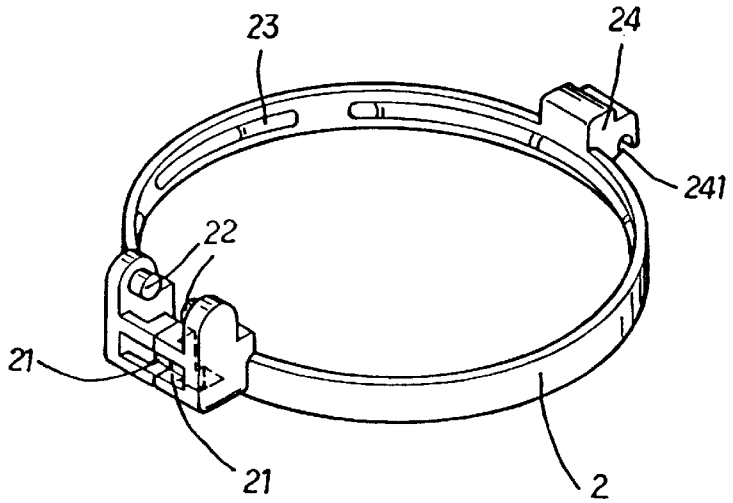
FIG. 5 is a perspective view of the split locating ring for the sealing container according to the present invention.

Referring to FIGS. 3 and 4, a sealing container is shown comprised of a container body 1, a locating ring 2, a clamping plate 20, a lever 25, a locking plate 26, a cover 3, and a rubber sealing ring 4. The container body 1 has an annular locating groove 10 around the periphery near the top rim thereof. The locating ring 2 is a split ring having two hook holes 21 and two pivots 22 symmetrically provided at two flanged ends thereof, a plurality of ribs 23 raised from the inside wall thereof corresponding to the annular locating groove 10 at the container body 1, and a fixed block 24 equally spaced from the flanged ends. The fixed block 24 comprises a transverse coupling groove 241 at its bottom side wall. The clamping plate 20 is fastened to the flanged ends of the locating ring 2 to fix the locating ring 2 to the container body 10, having two hooked ends 201 inwardly extended toward each other. The lever 25 comprises a coupling rod 251 transversely suspended at a substantially U-shaped front end thereof, and two coupling grooves 252 aligned at the U-shaped front end at a bottom side. The locking plate 26 comprises a coupling rod 260 transversely suspended at one end thereof, a transverse slot 261 disposed adjacent to the coupling rod 260, and a downwardly extended hooked portion 262 at an opposite end thereof. The cover 3 fitting the locating ring 2, comprising a fixed barrel 31 and a fixed block 32 respectively raised from the periphery at two opposite sides, and an annular locating groove 30 provided at a bottom side thereof around the periphery. The barrel 31 defines a pivot hole 310. The fixed block 32 comprises an upwardly extended hooked portion 320 for engagement with the downwardly extended hooked portion 262 at the locking plate 26.

The assembly process of the present invention is simple, and outlined hereinafter with reference to FIGS. from 5 through 7 and FIGS. 3 and 4 again, the rubber sealing ring 4 is fastened to the annular locating groove 30 at the cover 3, then the locating ring 2 is attached to the periphery of the container body 1, enabling the ribs 23 to be engaged into the annular locating groove 10 at the container body 1, and then the cover 3 is attached to the locating ring 2, enabling the pivots 22 of the locating ring 2 to be respectively inserted into the pivot hole 310 at the barrel 31, and then the clamping plate 20 is fastened to the two flanged ends of the locating ring 2 to secure the locating ring 2 to the container body 1 by hooking the hooked ends 201 of the clamping plate 20 in the hook holes 21 at the flanged ends of the locating ring 2, and then the lever 25 is inserted through the transverse slot 261 at the locking plate 26 and pivoted to the fixed block 24 at the locating ring 2 by forcing the transversely suspended coupling rod 251 of the lever 25 into engagement with coupling groove 241 at the fixed block 24 at the locating ring 2, and then the transversely suspended coupling rod 260 of the locking plate 26 is forced into engagement with the coupling grooves 252 at the lever 25, enabling the locking plate 26 to be pivoted to the lever 25.

Figure 6:
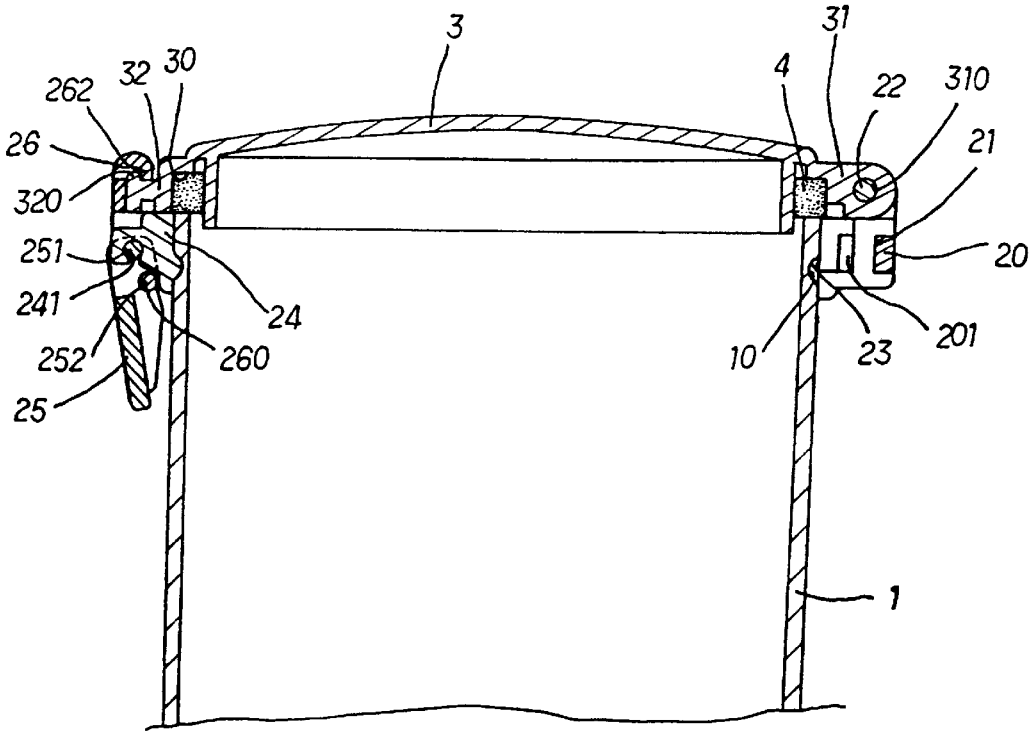
FIG. 6 is a sectional assembly view of the present invention, showing the cover closed and locked.
Figure 7:
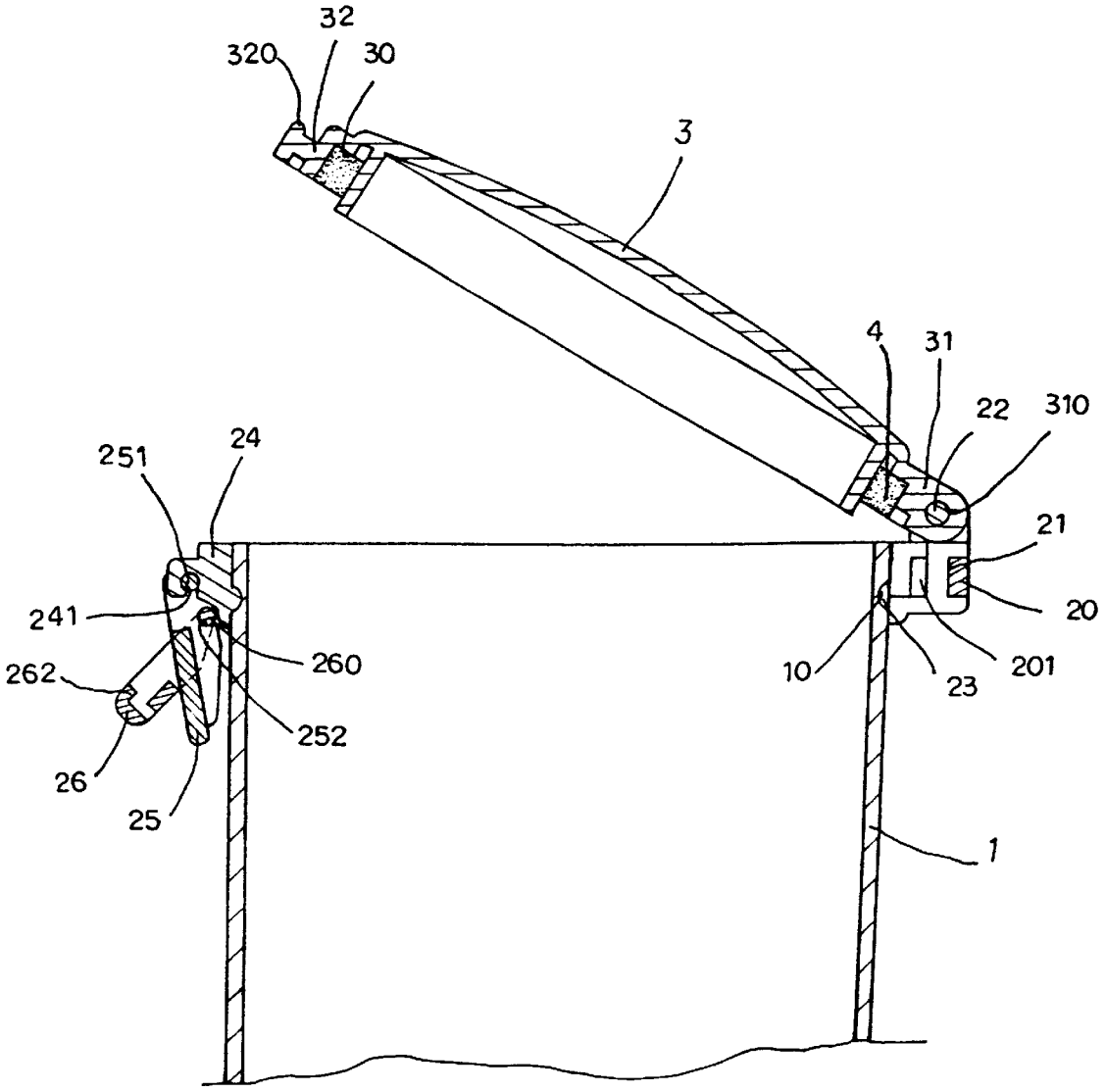
FIG. 7 is another sectional view of the present invention, showing the cover opened.

Referring to FIGS. 6 and 7 and FIG. 3 again, when the cover 3 is closed on the container body 1, the rubber sealing ring 4 is forced into engagement with the top rim of the container body 1 to seal the gap, then the locking plate 26 is lifted, enabling the hooked portion 262 of the locking plate 26 to be hooked up with the hooked portion 320 of the fixed block 32 at the cover 3, and then the lever 25 is turned downwards to pull down the locking plate 26, thereby causing the locking plate 26 to be retained in the locking position. When opening the cover 3, the lever 25 is lifted to release the locking plate 26 from the constraint of the lever 25, enabling the locking plate 26 to be disengaged from the fixed block 32 at the cover 3.

While only one embodiment of the present invention has been shown and described, it will be understood that various modifications and changes could be made thereunto without departing from the spirit and scope of the invention disclosed.

What the invention claimed is:

1. A sealing container, comprising:

a container body, said container body comprising an annular locating groove around the periphery thereof near a top rim thereof;

a split locating ring mounted on said container body around the annular locating groove at said container body, said split locating ring comprising two flanged ends, said flanged ends each comprising a hook hole and a pivot, a plurality of ribs raised from an inside wall thereof and respectively engaged into the annular locating groove at said container body, and a fixed block raised from the periphery thereof and equally spaced from said flanged ends, the fixed block of said split locating ring comprising a transverse coupling groove at a bottom side wall thereof;

a clamping plate fastened to said flanged ends of said split locating ring to fix said flanged ends of said split locating ring together and to secure said split locating ring to said container body, said clamping plate comprising two hooked ends respectively hooked in the hook hole at each of said flanged ends of said split locating ring;

a cover pivoted to said flanged ends of said split locating ring for closing said container body, said cover comprising a fixed barrel and a fixed block respectively raised from the periphery thereof at two opposite sides, an annular locating groove provided at a bottom side thereof around the periphery, and a rubber sealing ring fastened to the annular locating groove for sealing said container body, said fixed barrel comprising a pivot hole coupled to the pivot at each of said flanged ends of said split locating ring, the fixed block of said cover comprising a downwardly extended hooked portion;

a lever pivoted to the fixed block at said split locating ring, said lever comprising a coupling rod transversely suspended at a substantially U-shaped front end thereof and coupled to the coupling groove at the fixed block at said split locating ring, and two coupling grooves aligned at said U-shaped front end at a bottom side; and a locking plate pivoted to said lever and controlled by said lever to lock said cover, said locking plate comprising a coupling rod transversely suspended at one end thereof and coupled to the coupling grooves at said lever, a transverse slot disposed adjacent to the coupling rod of said locking plate for the passing of the U-shaped front end of said lever, and a downwardly extended hooked portion at an opposite end thereof for hooking up with the hooked portion at the fixed block at said cover.

* * * * *